United States Patent [19]

Mouret et al.

[11] 4,067,388

[45] Jan. 10, 1978

[54] HYDRAULIC OPERATED CASING HANGER RUNNING TOOL

[75] Inventors: Edmund M. Mouret, Houston; Michael R. Garrett, Spring, both of Tex.

[73] Assignee: FMC Corporation, San Jose, Calif.

[21] Appl. No.: 783,993

[22] Filed: Apr. 4, 1977

Related U.S. Application Data

[63] Continuation of Ser. No. 681,641, April 29, 1976.

[51] Int. Cl.[2] ..... E21B 43/10

[52] U.S. Cl. ..... 166/208; 166/212

[58] Field of Search ..... 166/16, 125, 181, 182, 166/208, 212

[56] References Cited

U.S. PATENT DOCUMENTS

| | | | |
|---|---|---|---|
| 3,450,421 | 6/1969 | Harwell, Jr. | 166/.6 |
| 3,543,847 | 12/1970 | Heaber | 166/208 |
| 3,827,488 | 8/1974 | Piazza et al. | 166/182 |
| 3,885,625 | 5/1975 | Ahlstone | 166/181 |
| 3,897,823 | 8/1975 | Ahlstone | 166/126 |
| 3,918,747 | 11/1975 | Putch | 166/208 |

*Primary Examiner*—James A. Leppink

*Attorney, Agent, or Firm*—W. W. Ritt, Jr.; C. E. Tripp

[57] ABSTRACT

A well tool for running and landing underwater casing hangers. The tool includes a resilient split ring with external threads that engage complementary internal threads on the hanger, and an hydraulic system that is actuated through a control line at the surface, thereby facilitating release of the hanger from the tool by either hydraulic pressure or rotation of the running string to which the tool is attached.

9 Claims, 8 Drawing Figures

FIG_1
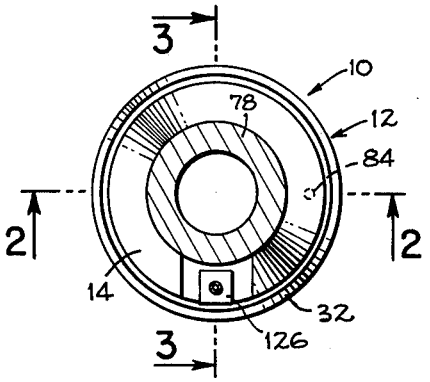
FIG_2
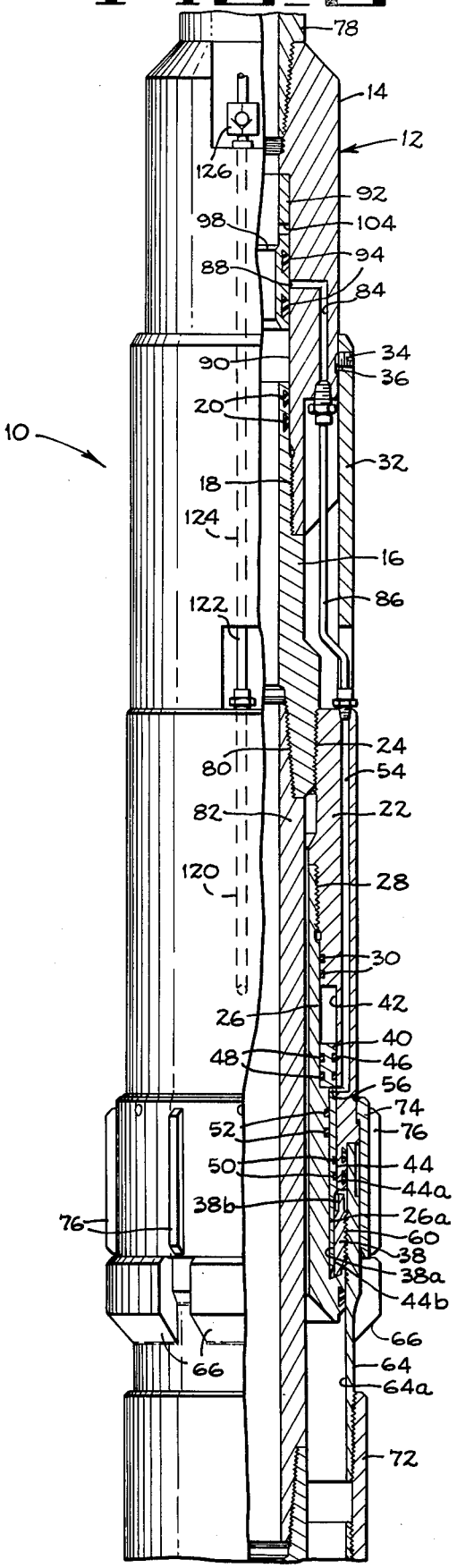
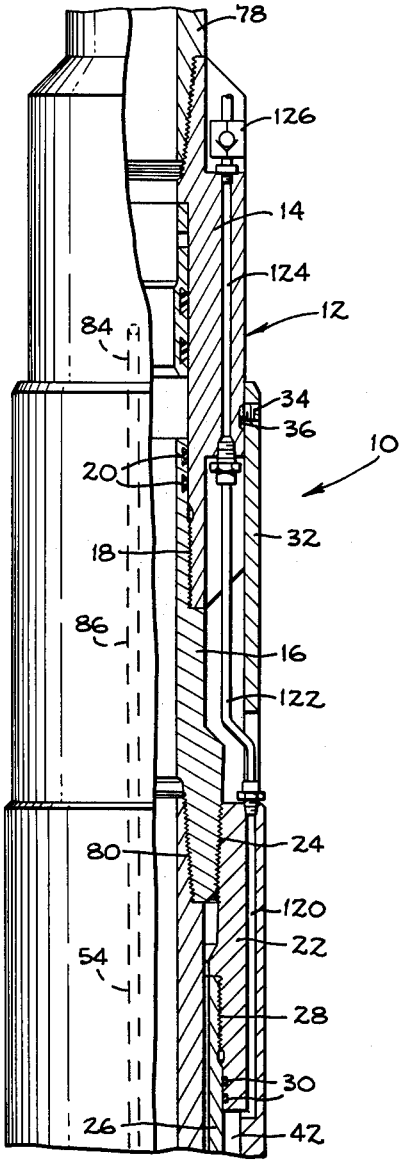
FIG_3

HYDRAULIC OPERATED CASING HANGER RUNNING TOOL

This is a continuation, of application Ser. No. 681,641 filed Apr. 29, 1976.

BACKGROUND OF THE INVENTION

This invention relates to well tools, and more specifically to casing hanger running tools for use in underwater oil and gas wells. In particular, the invention relates to hydraulic operated well tools for running, and landing underwater casing hangers without having to rotate the running string.

For many years it has been common practice in the oil and gas industry to run and land underwater well casing hangers by means of a tool that is threaded to the hanger, and that is released from the hanger by rotation of the tubular running string, such as a string of drill pipe, at the surface. However, practical that may be in some instances, past experience has proven that it is often difficult and undesirable in deep water drilling to rotate the running string, especially where high torques must be applied to the string in order to perform downhole operations.

Numerous attempts to overcome this problem have been devised, but none has been found completely satisfactory. For example, U.S. Pat. No. 3,827,488 to Piazza et al discloses a casing hanger assembly that is threaded onto a running tool, and in order to release the tool from the hanger assembly the running string must be rotated. Another type of casing hanger apparatus for use in underwater wells is shown in U.S. Pat. No. 3,885,625 to Ahlstone, but here again the hanger is connected to the tool only by threads, thereby necessitating rotation of the running string to disengage the tool from the hanger. Still another system for running and landing a casing hanger assembly in an underwater well is described in U.S. Pat. No. 3,897,823, also to Ahlstone, and although hydraulic pressure is employed to actuate a packing in the wellhead, the running string must be rotated to release the running tool from the hanger.

In U.S. Pat. No. 3,543,847 to Haeber, there is disclosed a casing hanger and running tool combination that employs hydraulic pressure to release the tool from the hanger. However, the tool and hanger are interconnected by a complex system of locking dogs, springs, and dog cage that are expensive to manufacture and relatively highly vulnerable to damage and malfunction.

SUMMARY OF THE INVENTION

Broadly considered, the present invention comprises a hydraulically operable well tool for running and landing another well tool, such as a casing hanger, in a remotely located wellhead, as for example an underwater wellhead at an offshore location. The well tool of this invention has a resilient split latch ring that functions to releasably interconnect the tool with the casing hanger or other well device, and a hydraulically operated piston that functions to expand the latch ring and lock it in its expanded condition wherein it secures the tool and hanger together. When the piston is actuated to withdraw it from its ring-locking position, the latch ring contracts and releases the well tool from the hanger, thereby facilitating removal of the tool from the well by simply lifting the running string.

The latch ring is inherently biased into a contracted condition, and preferably has external threads that engage complementary internal threads in the casing hanger. Thus, the well tool of this invention can be released from the hanger not only by hydraulic pressure as mentioned above, but in an emergency also by rotation of the running string to unthread the tool from the hanger. This dual release system provides the operator with a backup disconnecting means that is a significant advantage over the other known hanger running tool devices, especially where hydraulic pressure to the wellhead is accidentally lost.

Accordingly, one object of the present invention is to provide a new running tool for a casing hanger or other well device.

Another object of the present invention is to provide a casing hanger running tool that can be released from the hanger by actuation of a hydraulic pressure system.

Still another object of the present invention is to provide a new type of well tool that can be employed to run and land a casing hanger, released from the hanger, and then retrieved from the well all without rotation of the running string.

A further object of the present invention is the provision of a hydraulic operated casing hanger running tool with an emergency means for releasing it from the hanger by rotation of the running string, should hydraulic pressure to the tool be lost.

The foregoing and other objects, features, and advantages of the present invention will become more apparent from the following description of a preferred embodiment thereof, including the accompanying drawings, set forth to illustrate the general principals of the invention and not for purposes of limitation thereof.

BRIEF DESCRIPTION OF THE DRAWINGS

FIG. 1 is a plan view of a casing hanger running tool according to the present invention, with the tool attached to the lower end of a portion of drill pipe or other running pipe string.

FIG. 2 is a view partially in longitudinal section along the line 2—2 of FIG. 1, and partially in elevation, of the tool of FIG. 1 and a casing hanger connected thereto.

FIG. 3 is a view partially in longitudinal section along the line 3—3 of FIG. 1, and partially in elevation, of the upper portion of the tool of FIG. 1.

DESCRIPTION OF THE PREFERRED EMBODIMENT

Figure 4:
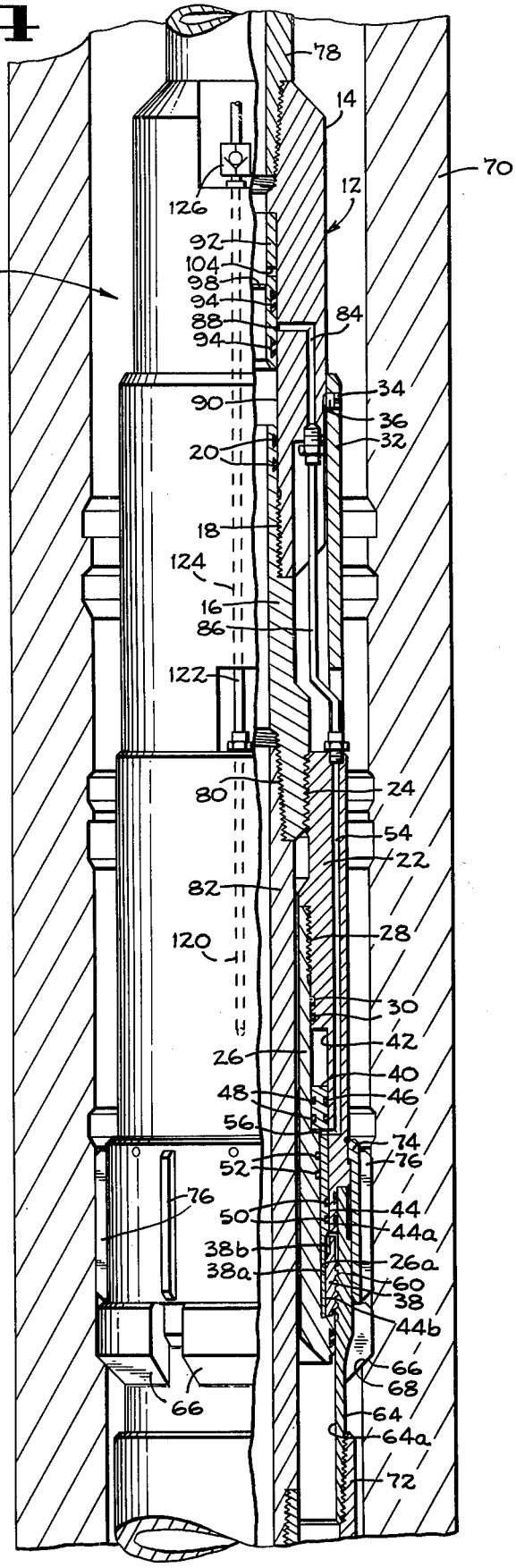
FIG. 4 is a view like FIG. 2, showing the hanger landed in a wellhead and still connected to the tool.

In reference first to FIGS. 1–3, one embodiment of hydraulic operated casing hanger running tool 10 according to this invention comprises a tubular body 12 having an upper member 14, an intermediate inner tubular member 16 threaded and sealed to the upper member 14 at 18,20, respectively, a lower outer tubular member 22 threaded at 24 to the intermediate member 16, a lower inner tubular member 26 threaded and sealed to the lower outer member 22 at 28,30, respectively, and an outer protective sleeve 32 that circumscribes the upper member 14 of the body 12 and is secured thereon by means of one or more set screws 34 (only one shown) that extends inwardly from threaded engagement with the sleeve 32 into a relieved area 36 in the outer surface of the upper member 14. The running tool 10 also includes an axially split, resilient latch ring 38 circumscribing the lower portion of the lower member 26 of the body 12, and an annular hydraulic-operated piston 40 disposed in an annular chamber 42 between the lower outer and inner members 22,26, respectively.

Figure 8:
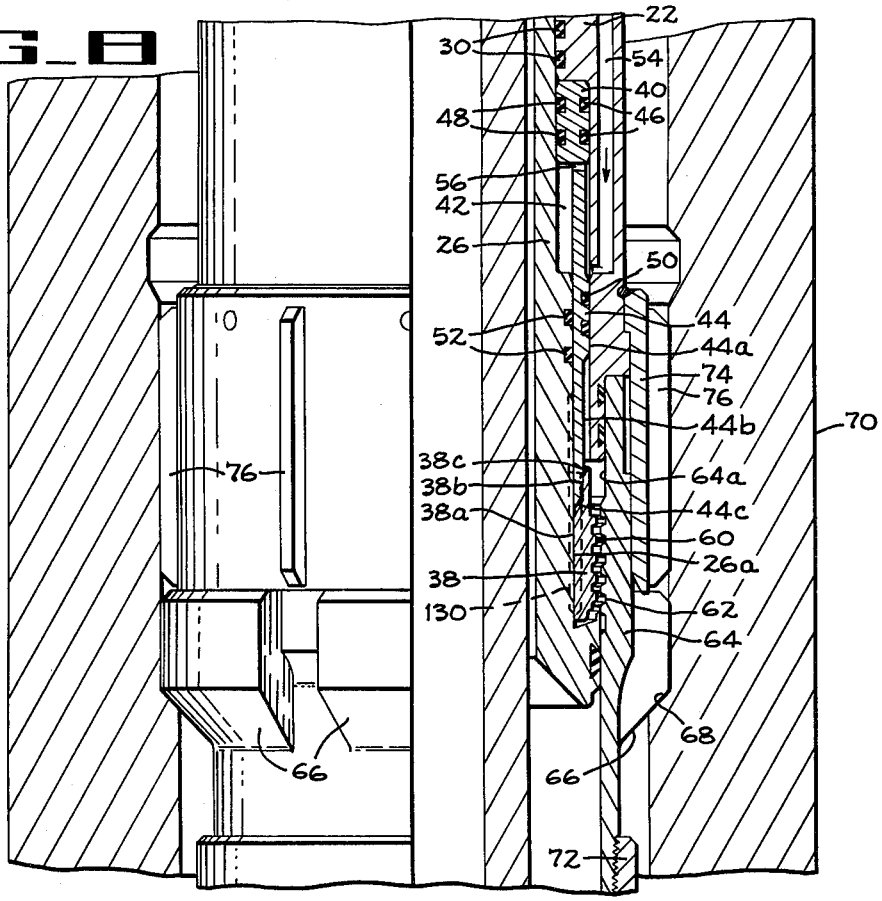
FIG. 8 is a view like FIG. 6, showing the hydraulic piston withdrawn from behind the latch ring in response to hydraulic pressure in the running string, the latch ring contracted out of engagement with the casing hanger, and thus the tool released from the hanger.

The resilient latch ring 38 is inherently biased into its contracted position as shown in FIG. 8, and the upper portion of its main inner annular surface **38*a* is counterbored or otherwise relieved to provide an upper inner annular surface 38*b* of larger diameter than the surface 38*a*, thereby to provide an inner annular space between the latch ring and the outer annular surface 26*a* of the member 26 when the ring is contracted against the member 26**.

The hydraulic piston 40 has a downward extending, lower skirt 44 that has an upper outer annular surface **44*a* and a lower annular surface 44*b*, the surface 44*b* having a diameter significantly less than the diameter of surface 44*a*. The outer edge of the lower end of the piston skirt 44 preferably is beveled at 44*c* to cooperate with a complementary bevel 38*c*; preferably included on the inner edge of the upper end of the latch ring 38, for facilitating movement of the skirt 44 downwardly behind the latch ring 38 when it is desired to expand the ring into its outer locking position as shown in FIGS. 2, 4 and 6**.

The piston 40 is statically and dynamically sealed to the running tool body members 22 and 26 by means of suitable annular seal elements 46,48, respectively. In like manner, the piston skirt 44 is sealed to the same body members 22,26 by suitable annular seal elements 50,52 respectively. Therefore, when sufficient hydraulic pressure is admitted through hydraulic passage 54 (FIGS. 2 and 4–8) the piston 40 and its skirt 44 will move upwardly from its lower or locking position shown in FIGS. 2, 4 and 6 into its upper or unlocked position as shown in FIG. 8, thereby withdrawing the piston skirt 44 from behind the lower annular surface **38*a* of the latch ring 38, and thus facilitating self-contraction of the latch ring into its released position shown in FIG. 8. As seen best in FIGS. 6 and 8, one or more ports 56 (only one shown) are provided through the upper portion of the piston skirt 44 to transmit hydraulic pressure from the passage 54 through the skirt so that this pressure can act on the entire under surface of the piston 40** to effect its upward movement.

Figure 6:
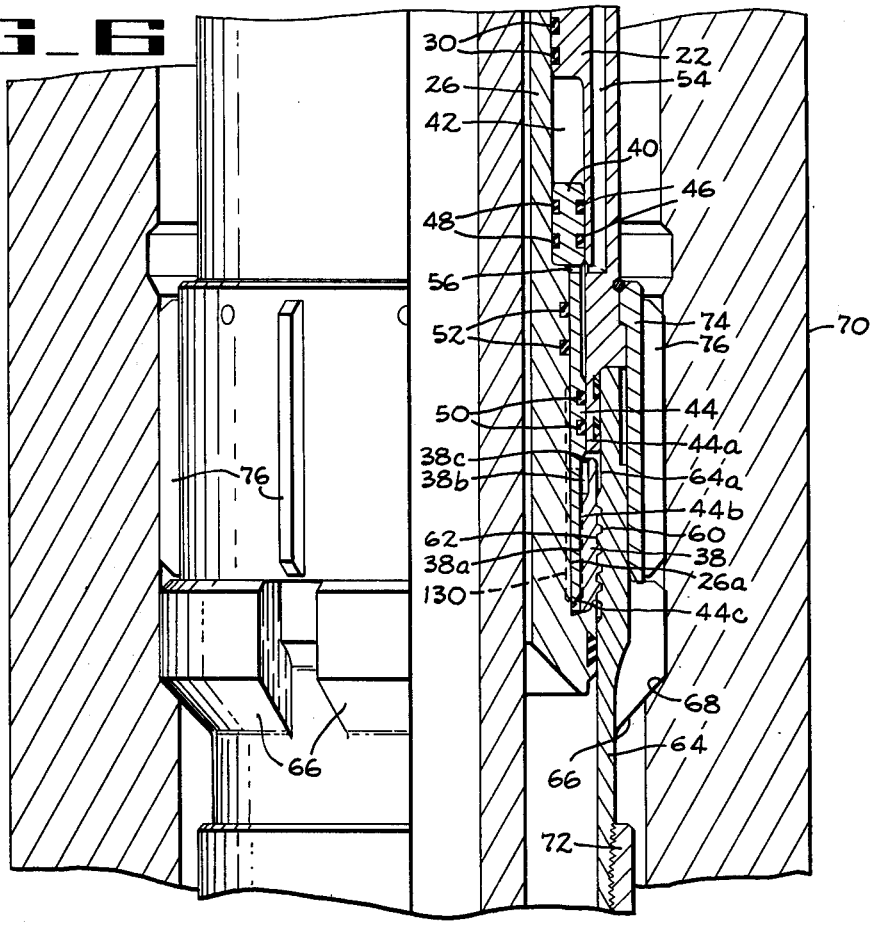
FIG. 6 is a fragmentary view on an enlarged scale, of the lower portion of the running tool as illustrated in FIG. 4, showing the tool and casing hanger locked together.
Figure 7:
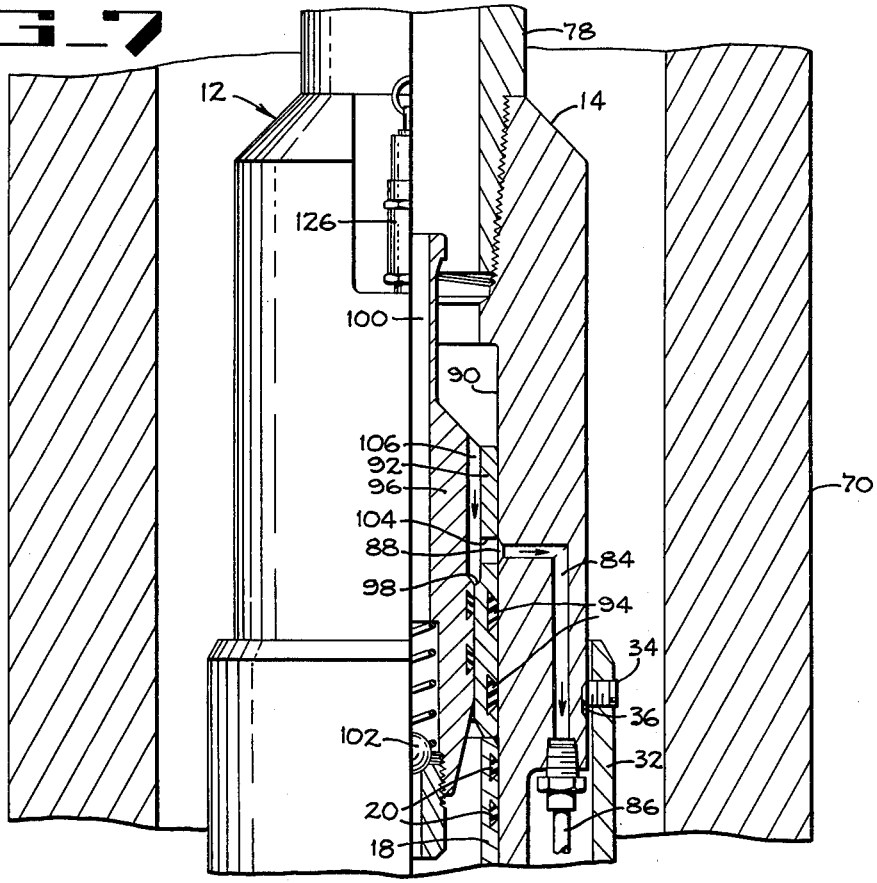
FIG. 7 is a view like FIG. 5, showing the tool and dart assembly following their subjection to hydraulic pressure down the running string.

The outer surface of the latch ring 38 preferably is provided with threads 60 that engage complementary threads 62 on the inner annular surface **64*a* of a casing hanger 64 when the latch ring is in its expanded position as shown in FIGS. 2, 4, and 6, thereby releasably interconnecting the hanger with the running tool 10. The casing hanger 64 is shown with a fluted annular support shoulder 66 that cooperates with an inner annular shoulder or seat 68 in a wellhead 70 to support the hanger, and the casing string 72** attached thereto, in the wellhead in the accepted manner.

Preferably the well tool 10 includes a centralizer sleeve 74 with external spaced centralizer ribs 76 that serve to maintain the tool and hanger 64 in proper location as they are being lowered into the wellhead 70 as an assembly on a running string 78. Furthermore, where the tool 10 is to be used in conjunction with cementing the casing 72 to the next outer casing string (not shown), as is the conventional practice, the lower end of the intermediate body member 16 is threaded at 80 (FIGS. 2 and 4) to provide a means for connecting to this member a cementing string indicated at 82.

Figure 5:
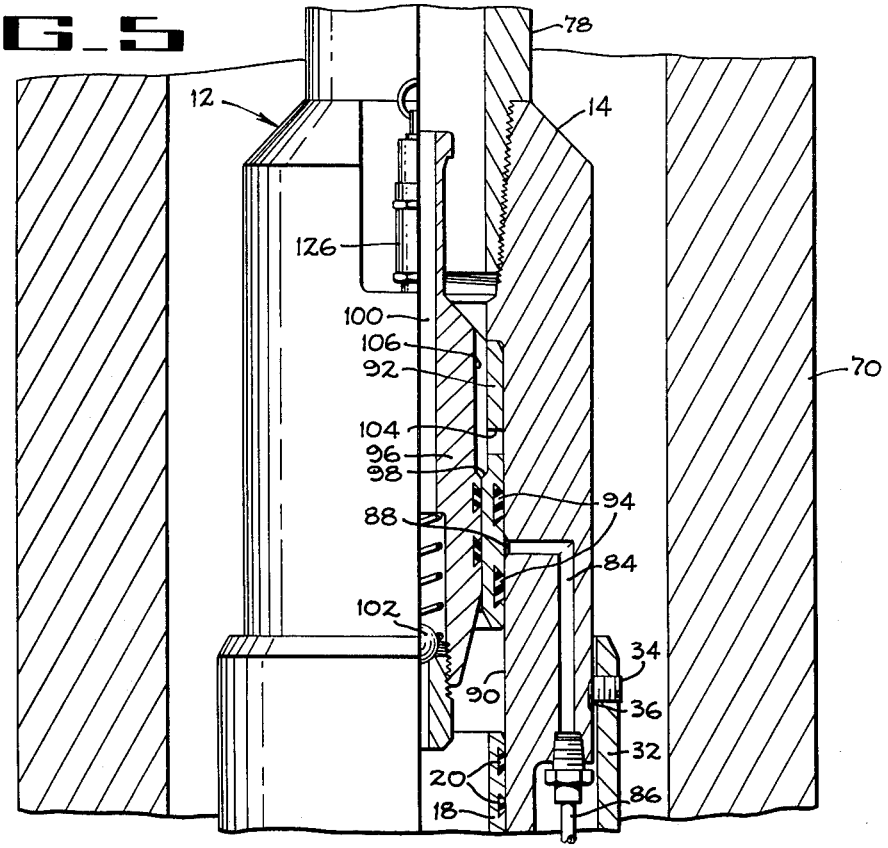
FIG. 5 is a fragmentary view on an enlarged scale, of the upper portion of the running tool as illustrated in FIG. 4, showing also a dart assembly in place in the upper end of the tool prepatory to being subjected to hydraulic pressure in the running string.

The hydraulic passage 54 in the lower outer body member 22 is interconnected with a hydraulic passage 84 in the tool's upper member 14 by means of a suitable hydraulic line 86 (FIGS. 2, 4, 6 and 8). The hydraulic passage 84 has an inlet 88 that communicates with the bore 90 of the upper member 14, and within this bore is a slidable sleeve valve 92, with annular seals 94, that normally resides in an upper position as shown in FIGS. 2, 4 and 5, to close the passage inlet 88.

When the hanger 64 has been landed in the wellhead 70 (FIG. 4), and it is desired to release the running tool 10 for retrieval, a dart element 96 (FIG. 5) is dropped down the running string 78 to land on an inner annular shoulder 98 in the sleeve valve 92. The dart 96 has a central bore 100 with a spring-biased check valve 102 closing its lower end. With the dart 96 in position as shown in FIG. 5, hydraulic pressure is applied at the surface to the running string 78, causing the dart 96 and sleeve valve 92 to move downwardly into their lower position shown in FIG. 7. In this lower position one or more ports 104 (only one shown) through the upper portion of the sleeve valve 92 interconnects the hydraulic passage inlet 88 with one or more axial grooves 106 in the outer surface of the dart 96, and hence ultimately with the fluid pressure in the running string 78. As a consequence, and as indicated by the arrows in FIGS. 7 and 8, this hydraulic pressure is conducted through the groove or grooves 106, the port or ports 104, the inlet 88, the passage 84, the line 86, and the passage 54 to bear against the piston 40 and force it upwardly from its lower locking position (shown in FIGS. 2, 4 and 6) into its upper position (shown in FIG. 8). As the upper outer surface **44*a* of the piston skirt 44 has moved upwardly from behind the latch ring 38, the ring contracts against the skirts lower outer surface 44*b*, thereby disengaging the threads 60,62 to release the tool 10 from the hanger 64. The tool 10 can then be retrieved for further use simply by lifting the running string 78, leaving the hanger 64 in properly landed position in the wellhead 70**.

In order to relieve the pressure in the chamber 42 above the piston 40 as the above described release operation is being performed, another hydraulic passage 120 (FIG. 3) in the tool's element 22 communicates with the upper end of the chamber 42. This passage 120 communicates with the well annulus or other space outside the well tool 10 and running string 78 by means of a hydraulic line 122, a hydraulic passage 124 in the tool's upper member 14, and a suitable relief valve 126 set at a predetermined pressure to prevent premature releasing of the piston. This hydraulic passage and line system also facilitates returning the piston to its lower position (FIGS. 2, 4 and 6) when the tool is at the surface in order to run and land another casing hanger, this being readily accomplished as by temporarily removing the check valve 126 and inletting hydraulic pressure through the passage 124, the line 122, and the passage 120.

As has been mentioned earlier, if for some reason, such as an accident, hydraulic pressure is lost before the running tool 10 is disengaged from the hanger 64, the tool can be released from the hanger by rotation of the running string 78, thereby unthreading the latch ring 38 from the hanger threads 62. So that the running tool body 12, the piston 40, and the latch ring 38 will rotate in unison as the running string 78 is rotated, a suitable antirotation lug 130, indicated by the dotted lines in FIGS. 6 and 8, is provided between the lower body element 26, the piston skirt 44, and the latch ring to non-rotatably lock these elements together without restricting their relative axial movement. Preferably the piston skirt 44 has a milled slot (not shown) to clear the anti-rotation lug 130, and the lug is designed so that when the piston 40 is in its uppermost or released position (FIG. 8) the slot still engages the lug, preventing mis-alignment of these two elements.

With the piston 40 in its lowermost position, and thus the latch ring 38 in its expanded position, the casing hanger 64 can be easily assembled at the surface onto the running tool 10 merely by threading the tool and hanger together into their relative positions shown in FIGS. 2, 4 and 6.

The advantages of the present invention over the known prior devices for running casing hangers are several, including: the absence of a need to rotate the running string and tool when hydraulic operation is possible; no separate hydraulic line between the tool and the surface is required; the effective area of the piston is greater on the top than on its bottom, thus creating a biased-locking effect in case hydraulic pressure is lost; one tool can easily be adapted to run casing hangers of various sizes; the size of the running string can be the same as the casing being run, thereby facilitating cementing procedures by allowing the operator to use standard pump down plugs; the tool also can be released merely by rotation of the running string, thus providing an emergency back-up procedure; and the same hanger can be run with either the hydraulic operated tool of this invention or by means of a standard threaded tool without need for modification.

Although the best mode contemplated for carrying out the present invention has been herein shown and described, it will be apparent that modification and variation may be made without departing from what is regarded to be the subject matter of the invention.

We claim:

1. A hydraulic operated well tool for running a well device into an underwater well, comprising:
   a. a tool body having means for connection to a pipe string,
   b. a split, resilient latch ring surrounding said tool body,
   c. means on said latch ring to threadedly engage said well device, said means facilitating release of said well tool from said well device by relative rotation between said tool and device,
   d. hydraulic piston means within said tool body and interconnected with said latch ring to actuate said latch ring into engagement with said well device, and
   e. means to conduct hydraulic pressure from a remote location to said hydraulic piston means to actuate said piston means and release said well tool from said well device without rotation of said tool body or said pipe string.

2. A well tool as defined in claim 1 wherein the latch ring is inherently biased towards a contracted position.

3. A well tool as defined in claim 1 wherein said hydraulic piston means locks said latch ring in its expanded position when said piston means is in one position in said tool body.

4. A well tool as defined in claim 1 wherein said movement of said hydraulic piston between two limits of its travel functions to change the condition of said latch ring between locked engagement with said well device and released non-engagement with said well device.

5. A well tool as defined in claim 1 wherein the means to conduct hydraulic pressure to said hydraulic piston means comprises a fluid conduit including said pipe string.

6. A well tool as defined in claim 1 including hydraulic means to reposition said hydraulic piston following actuation of said piston to release said well tool from said well device.

7. A well tool according to claim 1 wherein the well tool comprises a casing hanger running tool, and the well device comprises a casing hanger.

8. A well tool according to claim 1 including valve means to control hydraulic fluid flow between said hydraulic piston means and a remote source of hydraulic pressure, said valve means located in said tool body and operable to admit hydraulic pressure from said pipe string to said hydraulic piston means in response to actuation through said pipe string.

9. A hydraulic operated well tool for running a well device into an underwater well, comprising:
   a. a tool body having means for connection to a pipe string,
   b. a split, resilient latch ring surrounding said tool body,
   c. means on said latch ring and said well device to releasably interconnect said ring with said well device, said means including complementary threads facilitating threading said well tool and said well device together at a surface location, and unthreading said well tool and well device at a remote location by rotation of said well pipe,
   d. hydraulic piston means within said tool body and interconnected with said latch ring to actuate said latch ring into engagement with said well device, and
   e. means to conduct hydraulic pressure from a remote location to said hydraulic piston means to actuate said piston means and release said well tool from said well device without rotation of said tool body or said pipe string.

* * * * *